United States Patent [19]

Korger

[11] 3,937,480

[45] Feb. 10, 1976

[54] SAFETY SKI BINDING

[75] Inventor: Heinz Korger, Munich, Germany

[73] Assignee: Hannes Marker, Garmisch-Partenkirchen, Germany

[22] Filed: Feb. 21, 1974

[21] Appl. No.: 444,371

[30] Foreign Application Priority Data

Feb. 21, 1973 Germany ..... 2308602

[52] U.S. Cl. ..... 280/11.35 T

[51] Int. Cl.[2] ..... A63C 9/08

[58] Field of Search ..... 280/11.35 T, 11.35 K

[56] References Cited

UNITED STATES PATENTS

| | | | |
|---|---|---|---|
| 3,432,179 | 3/1969 | Marker | 280/11.35 T |
| 3,752,491 | 8/1973 | Fend | 280/11.35 T |
| 3,771,806 | 11/1973 | Hinterholzer | 280/11.35 T |

FOREIGN PATENTS OR APPLICATIONS

| | | | |
|---|---|---|---|
| 412,672 | 11/1966 | Switzerland | 280/11.35 K |

*Primary Examiner*—Robert R. Song
*Attorney, Agent, or Firm*—Fleit & Jacobson

[57] ABSTRACT

The skiing boot is connected to the ski by a separate soleplate, which in each of its forward and rear portions has at least one soleholder and to which the skiing boot is secured so as to be only arbitrarily adjustable. A plate holder is mounted on the ski and comprises a pivot bearing for the soleplate adjacent to the rear half of the latter. Adjacent to the rear end of the soleplate, the plate holder is provided with an element of a detent device, which in response to an overload in a vertical and/or horizontal direction releases the soleplate. Adjacent to the forward portion of the soleplate the plate holder is provided with a member for holding down the soleplate. The female detent element of the detent device is part of the plate holder. The male detent element of the detent device is provided on the soleplate. The soleplate is provided with raised side cheeks adjacent to the detent device. The male detent element, the spring acting on said male detent element, and the bracket for the rear soleholder are mounted on said side cheeks.

13 Claims, 5 Drawing Figures

SAFETY SKI BINDING

The present invention relates to safety ski bindings in which the skiing boot is connected to the ski by a separate soleplate, which in each of its forward and rear portions has at least one soleholder and to which the skiing boot is secured so as to be only arbitrarily detachable, and a plate holder, which is mounted on the ski and adjacent to the rear half of the soleplate has a pivot bearing for the latter, and adjacent to the rear end of the soleplate is provided with an element of a detent device, which in response to an overload in a vertical and/or horizontal direction releases the soleplate, whereas the plate holder is provided adjacent to the forward portion of the soleplate with a member for holding down the soleplate.

Such safety ski bindings, which are known so far only from printed publications, possess considerable advantages over the commercially available safety ski bindings having a soleplate. For instance, the pivot bearing for the soleplate ensures that the same will not be clamped, e.g. when the ski moves through a depression. Besides, as the skiing boot is inserted into the binding the skiing boot is automatically secured to the soleplate so as to be only arbitrarily detachable there from. As a result, the skier need not manipulate the ski binding before starting.

On the other hand, the first-mentioned safety ski bindings which are known only from printed publications have the disadvantage that they involve a high structural expenditure, which adds to the size and weight of the binding and adversely affects the functional reliability and appearance thereof. This is probably the reason, why these safety ski bindings have not found commercial accpetance.

It is an object of the invention to avoid that disadvantage. In a safety ski binding in which the skiing boot is connected to the ski by a separate soleplate, which in each of its forward and rear portions has at least one soleholder and to which the skiing boot is secured so as to be only arbitrarily detachable, and a plate holder, which is mounted on the ski and adjacent to the rear half of the sole plate has a pivot bearing for the sole plate and adjacent to the rear end of the sole plate is provided with an element of a detent device, which in response to an overload in a vertical and/or horizontal direction releases the soleplate, whereas the plate holder is provided adjacent to the forward end of the soleplate with a member for holding down the soleplate, this object is accomplished according to the invention in that the female detent element of the detent device is part of the plate holder, the male detent element of the detent device is provided on the soleplate, the soleplate is provided with raised side cheeks adjacent to the detent device, and the male detent element, the spring acting on said male detent element, and the bracket for the rear soleholder are mounted on said side cheeks.

The structure will be both compact and particularly simple if the bracket for the soleholder is pivoted in the side cheeks of the soleplate and provided with a closing pedal and has at least one locking nose, which cooperates with a spring-loaded latch, which locks the soleholder in its locking position. The pivot of the leverlike male detent element of the detent device may be pivoted in the side cheeks of the soleplate and may serve also as a pivot for the latch. In a structural development of this concept of the invention, the latch consists suitably of a two-armed lever, whose second arm forms an abutment for at least one spring, which at its other end engages the bracket for the soleholder. The latch may be pivotally connected to an unlocking member for an arbitrary operation of the latch.

For the sake of functional reliability and of appearance the spring of the detent device is desirably accommodated in a housing which in its inner end wall has an aperture through which a push piece extends by which the spring acts on the male detent element.

Another feature of the present invention may be adopted even independently of the above-mentioned features of safety ski bindings and resides in that the housing of the spring-loaded detent device accommodates an adjusting device for changing the bias of the detent device, which adjusting device comprise an adjusting member, which carries a pivot pin for a lever through which the spring acts on the male detent element.

In a structural development of that concept of the invention the lever may be one-armed and have fixed points for engaging the spring and the male detent element. Besides, the adjusting member may consist of a pivoted lever and be pivotally movable by a power screw. In this case it will be desirable to use the free end of the pivoted lever as a pointer, which extends at least into an opening in a housing wall, which at the edge of said opening is provided with a scale.

Particularly in a safety ski binding which embodies the main feature of the present invention it will be desirable to arrange the bracket for one of the solholders so as to be longitudinally slidably held on the soleplate or baseplate by means of a slidable clamping member, which is connected by a power screw to the bracket. That design permits of a fast and simple adaptation of the ski bindings to boot soles differing in length. In an arrangment which has been found satisfactory, the slidable clamping member extends through a slot in the soleplate or baseplate and has side edge portions for engaging the longitudinal edges of the slot from below and at least one side edge portion of the slidable clamping member is provided with teeth which in the clamping position of said member mesh with mating teeth under the soleplate or base plate. Particularly with a view to the re-establishment of the toothed mesh after an adjusting operation it will be desirable to provide a retaining spring, which is mounted on the screw and holds the slidable clamping member in a clamping position even when the screw has been loosened. When the bracket for the sole-holder has been shifted and the teeth of one part are not in registry with the spaces between the teeth of the other part, a slight reciprocation of the bracket for the sole-holder will be sufficient to establish the proper relation in which the teeth come into mesh automatically.

A safety ski binding which embodies the features of the invention will be described more fully hereinafter with reference to the accompanying drawings, in which FIG. 1 is a longitudinal sectional view taken on line I—I of FIG. 2 and showing the safety ski binding according to the invention;

Figures 1, 2:
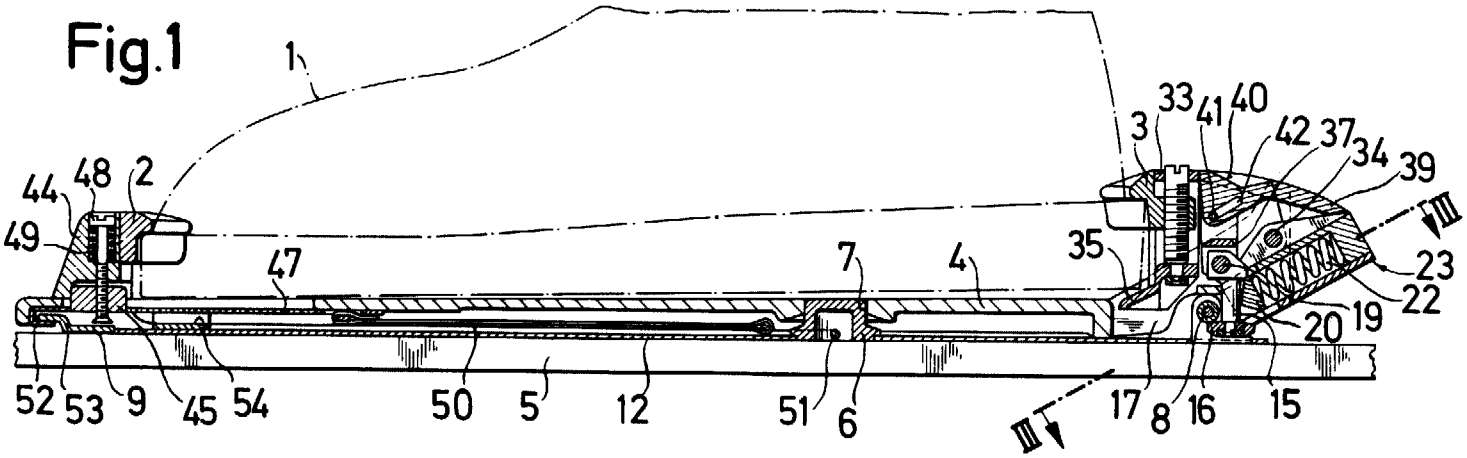
FIG. 2 is a top plan view showing the safety ski binding according to FIG. 1.

The safety ski binding which embodies the present invention and is shown on the drawing is a so-called plate binding, in which the skiing boot 1, which is indicated in dash-dot lines only in FIG. 1, is held on the soleplate 4 by forward and rear soleholders 2 and 3, respectively. Whereas the skiing boot 1 can be only arbitrarily detached from the soleplate 4, the soleplate can be automatically released from device by which the soleplate is secured to the ski 5, and from the latter, in response to a force which acts not only for a short time and which exceeds a predetermined magnitude.

The plate holder comprises a pivot bearing for the soleplate 4. In the present case the pivot bearing comprises a pivot pin 6, which extends into a mating hole 7 in the soleplate. Adjacent to the rear end of the soleplate the plate holder comprises an element 8 of a detent device which releases the soleplate in response to an overload acting in a vertical and/or horizontal direction. Adjacent to the forward portion of the soleplate the plate holder has a member 9 for holding down the soleplate (see particularly FIG. 1). As is apparent from FIG. 2, the pivot pin 6 has a flange 10, which is secured to the ski 5 by two screws 11. Each of the portions 8 and 9 of the plate holder is also secured to the ski by two screws.

Figure 3:
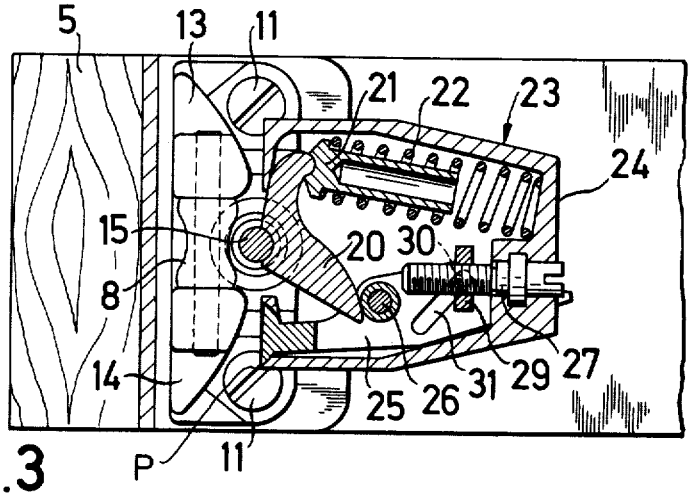
FIG. 3 is a partly sectional view taken on line III—III of FIG. 1.
Figure 4:
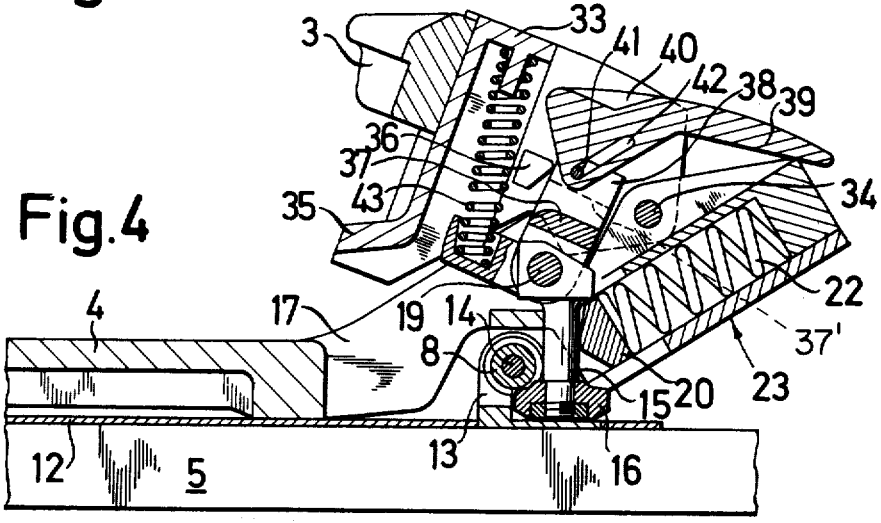
FIG. 4 is a partly sectional view taken on line IV—IV of FIG. 2 but with the soleholder unlocked.

To facilitate the mounting of the plate holder on the ski 5, their three functionally required individual parts 6, 8, and 9 are held in a fixed position relative to each other by a preassembling plate 12 (see FIGS. 1, 3, and 4). The parts are suitably mounted on the preassembling plate in the factory before the safety ski binding is packaged.

According to a feature of the present invention, the female detent element 8 of the detent device is provided on the plate holder and consists, e.g., of a centrally constricted roller, which is best shown in FIG. 3. This roller 8 is rotatably mounted on a transverse horizontal axle 14, which is mounted in a bracket 13, which is screw-connected to the ski 5. The male detent element of the detent device is mounted on the soleplate 4 and consists e.g., of a lever 15, which is substantially circular in cross-section and at its free end carries a roller 16. For mounting the element 15, the soleplate is provided with raised side cheeks 17, 18 adjacent to the detent device (see FIGS. 1, 2, and 4). Between these side cheeks, the lever 15 is mounted on a horizontal axle 19, which extends transversely to the longitudinal direction of the plate. The lever 15 is acted upon by another lever 20 (see particularly FIGS. 3 and 4). The spring 22 of the detent device urges a mushroom-shaped member 21 against the free end of the lever 20. These parts are accommodated in a housing 23, which is disposed between the side cheeks 17, 18 and has an outer end wall 24 abutted by the spring. The lever 20 is spring loaded upon the lever 15 to be yieldingly held thereagainst.

The bias on the male detent element consisting of the lever 15 may be changed by a change of the effective length of the lever arm of the lever 20. For this purpose the housing 23 contains an adjusting member, which consists of a pivoted lever 25, which has attached thereto a pivot pin 26 which engages one end of the lever 20. As shown in FIG. 3, the lever 25 has a pivot point P on the housing. The pivoted lever 25 is pivotally movable by means of a power screw 27, which is mounted in the housing wall 24 and is provided at its outer end with a slot for engagement by a screwdriver. A nut 29 is threaded on the screw and provided with a coupling member 30, which extends into a slot 31 in the pivoted lever 25 so that the latter is pivotally moved in response to a rotation of the screw 27. The free end of the pivoted lever 25 extends through an opening 32 in the housing wall 24 (see FIG. 2) and constitutes a pointer of a device for indicating the force required for a release of the safety ski binding. This indicating device has a scale at one edge of the opening 32.

The rear soleholder 3 is secured to a bracket 33, which is pivoted on a horizontal axle 34, which extends transversely to the longitudinal direction of the plate and is held in the side cheeks 17, 18 of the soleplate 4. The rear soleholder is adjustable in height for adaptation to soles differing in thickness. The bracket is substantially U-shaped (see particularly FIG. 2) and has a web which at that end which is the lower end in the drawings is provided with a closing pedal 35. The two legs of the bracket carry respective, mutually opposite locking cams 36, which cooperate with a latch 37, which locks the bracket 33 in the position in which the soleholder 3 is locked. The latch consists of a bell-crank lever and is also mounted on the axle 19 and has a central recess, which receives the bearing eye of the detent lever 15. That arm of the latch 37 which extends upwardly in FIGS. 1 and 4 is provided at its free end with two locking noses, one of which is designated by the reference numeral 37', which are respectively disposed before and behind the plane of the drawing, and a central transverse slot 38, which receives an unlocking member 39. The latter has a depression 40 for receiving the pointed end of a ski pole and is connected to the latch by a transverse pin 41, which extends through a slot 42 in the unlocking member. The other arm of the latch 37 is biased by two helical compression springs 43, which are symmetrically disposed with respect to the vertical center plane of the soleplate 4 and one of which is shown in FIG. 4. The upper end of each of these helical compression springs bears on the bracket 33 so that these springs are under initial stress.

The soleholder 3 and its bracket 33 are shown in locked position in FIG. 1 and in an open position in FIG. 4. This position must be assumed by the binding before the skiing boot 1 can be inserted. As the skiing boot is inserted into the binding, the sole strikes on the closing pedal 35 so that the bracket 33 is pivotally moved about the axle 34. This movement is transmitted by the helical compression springs 43 to the latch 37, the locking noses of which initially engage at their end faces the locking cams 36 of the bracket 33. When the bracket has been swung down by the sole, the helical compression springs 43 cause the locking noses of the latch 37 to engage the locking cams 36 from above to lock the bracket 33 against an upward pivotal movement. When the skiing boot has thus been automatically locked to the soleplate as the boot has been introduced into the binding, the boot can be released from the soleplate 4 only arbitrarily in that pressure is applied to the unlocking member 39, e.g., by a ski pole.

Reference is now made to FIG. 1, in which the safety ski binding is shown in its locking position. When the unlocking member 39 is depressed, the pin 41 of the latch 37 and the latter are pivotally moved in a clockwise sense and the helical compression springs 43 are thus increasingly stressed as long as the locking cams 36 are engaged by the locking noses of the latch 37. When the locking noses have released the locking cams and the skiing boot is lifted, the helical compression springs 43 turn the bracket 33 to the position shown in FIG. 4 so that the skiing boot is released. When the unlocking member 39 has been released, it assumes the position shown in FIG. 4.

Figure 5:
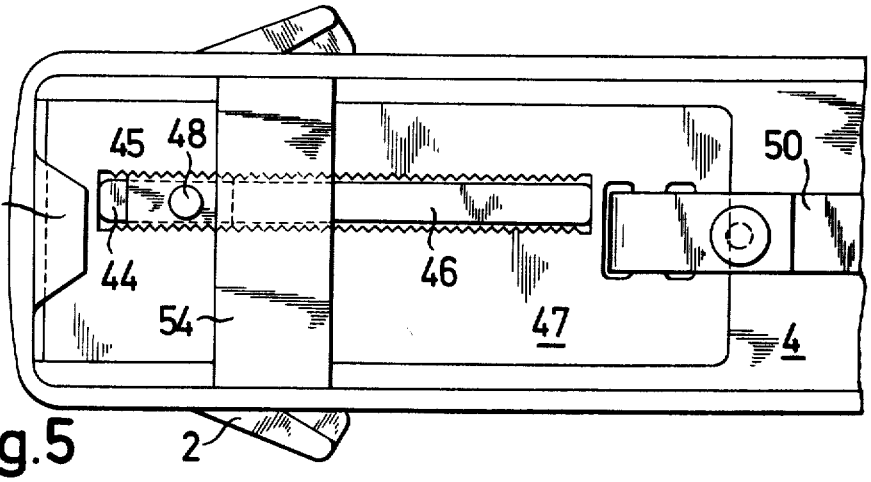
FIG. 5 is a bottom view showing the forward end portion of the soleplate.

The forward soleholder 2 is also connected to the soleplate 4 by a bracket 44, to which the soleholder is held so as to be adjustable in height for adaptation to soles differing in thickness. For adaptation to soles differing in length, the bracket is longitudinally slidably connected to the soleplate 4 by a slidable clamping member 45, and a power screw is provided to clamp the bracket in position. The slidable clamping member extends through a slot 46 in the soleplate 4 and has protruding longitudinal side edge portions for engaging the longitudinal edge portions of the slot 46 from below. The two longitudinal side edge portions of the slidable clamping member are provided with teeth and in clamping position mesh with mating teeth in a plate 47, which is provided on the soleplate 4, which is recessed on its underside (see particularly FIG. 5).

The power screw 48 has a head formed with a slot for engagement by a screwdriver and is mounted in the bracket 44 and threaded into a tapped hole of the slidable clamping member 45. The shank of the headed screw is surrounded by a helical compression spring 49, which is fully compressed in the clamping position shown in FIG. 1. For a longitudinal displacement of the bracket 44, the headed screw 48 must be loosened. In that case the teeth of the slidable clamping member 45 initially remain in mesh with the mating teeth on the underside of the soleplate 4 because the helical compression spring 49 expands. The teeth can be disengaged in that the headed screw 48 is forced down against the spring force. The bracket 44 may now be pushed into engagement with the sole of the skiing boot 1 which has been introduced into the binding. The toothed mesh is re-established as the headed screw is released. If the teeth fail to mesh because the teeth of the slidable clamping member are not in registry with the spaces between the teeth of the plate 47, it will be sufficient slightly to reciprocate the bracket 44 in the longitudinal direction of the soleplate so that the teeth will mesh automatically as the prestressed helical compression spring 49 tends to pull the slidable clamping member upwardly. When the toothed mesh has been re-established, the headed screw must be tightened firmly.

It has been pointed out that FIG. 1 shows the safety ski binding in a condition ready for skiing, with the skiing boot held on the soleplate 4. When an upwardly directed force at right angles to the surface of the ski acts on the leg of the skier when skiing and thus acts on the soleplate and said force exceeds not only for a short time the bias on the male detent element 15, the latter will disengage the female detent element 8 and the soleplate can separate from the ski 5. After such separation, the spring 22 and the member 21 maintain urging force on one end of the lever 20 while the other end of lever 20 maintains contact with pin 26. Therefore, the lever 20 is yieldingly retained in seating engagement on the lever 15. Similarly, the soleplate is released from the ski in response to forces which act not only for a short time transversely to the longitudinal direction of the ski and exceed the bias on the male detent element. It will be understood that the soleplate will also be released from the ski in the case of diagonal falls when the force reaches a value which is dangerous to the skier's leg.

A retaining belt 50 is provided to maintain a loose connection between the soleplate 4 and the ski 5 after a safety release. One end of the belt 50 is secured to an eye 51, which is mounted on the pivot 6 (FIG. 1). The other end of the belt 50 is secured to the plate 47 in the recessed soleplate 4. The soleplate is provided at its forward end with a hook 52, which engages an offset lug 53 of the holding-down member 9 from below. In the range in which the forward soleholder 2 is adjustable, the soleplate 4 has a cross-member 54, which bears on the preassembling plate 12. The materials are properly selected to minimize the friction between the cross-member and the preassembling plate during the pivotal movement of the soleplate.

When the skier desires to re-enter the ski 5 when the soleplate 4 has been released after a fall, he can hook in the forward end of the soleplate and then depress the rear end of the soleplate so that the pivot pin 6 enters the hole 7, which is greatly enlarged at its lower end, and the male detent element 15 falls into the female detent element 8. Alternatively, when the soleplate 4 extends transversely to the ski 5, the skier may engage the pivot pin 6 with the hole 7 and then move the soleplate so that it extends parallel to the ski, whereafter the soleplate is hooked in at its forward end and locked by the detent device at its rear end.

What is claimed is:

1. A safety ski binding for a ski comprising:

a soleplate adapted to be mounted on the ski for connecting a skiing boot to the ski;

a first sole holder in a forward position on the ski;

a second sole holder mounted in rear position on the ski;

a plate holder adapted to be attached to the ski;

releasing means on the second sole holder comprising detent means operative in response to an overload condition to release the soleplate from the ski comprising a female detent element mounted on said plate holder, a male detent element mounted on said soleplate and a detent spring means acting on said male detent element forcing said male element into engagement with said female element, said spring means being adjustable to change the force of engagement between said male and female elements thereby adjusting said releasing means.

2. A safety ski binding according to claim 1, including at least two side cheeks mounted on said soleplate and a bracket mounted on said side cheeks and further including a closing pedal on said bracket, at least one locking cam on said bracket, a spring-loaded latch having at least one locking nose cooperating with said locking cam to lock said second soleholder in a locking position.

3. A safety ski binding according to claim 2, wherein said male detent element includes a pivot means pivotally connected in each of said side cheeks and serves as a pivotal connection between said spring-loaded latch and said side cheeks.

4. A safety ski binding according to claim 2, characterized in that said spring-loaded latch further comprises a latch lever having two arms, one arm of which forms an abutment, and a lever spring mounted with one end engaging said bracket and the other end abutting said abutment of said two-armed latch lever.

5. A safety ski binding according to claim 2 further including an unlocking member pivotally connected to said spring-loaded latch.

6. A safety ski binding according to claim 1, further including a housing for said detent spring means comprising an inner end wall having an aperture defined therein and a push piece extending through said aperture by which said detent spring means acts on said male detent element.

7. A safety ski binding according to claim 6, further including an adjusting device for changing the bias of the detent spring means, which adjusting device is mounted in the housing of said detent spring means and comprises an adjusting member, a pivot pin and an adjusting lever through which the detent spring means acts on said male detent element.

8. A safety ski binding according to claim 7, wherein said adjusting lever is one-armed and has fixed points engaging said detent spring means and said male detent element.

9. A safety ski binding according to claim 7, characterized in that the adjusting device further comprises a pivoted mounting lever and a power screw for adjusting said adjusting device.

10. A safety ski binding according to claim 9, including a pointer on one end of said pivoted mounting lever extending into an opening in the housing wall and a scale on said housing adjacent the edge of said opening.

11. A safety ski binding according to claim 2 wherein said bracket includes a slidable clamping member for longitudinally slidably holding one of said soleholders onto said soleplate and a clamping screw for connecting said slidable clamping member to said bracket.

12. A safety ski binding according to claim 11, further including teeth on said soleplate and wherein said slidable clamping member extends through a slot in the soleplate and includes side edge portions for engaging the edges of the slot and including teeth on at least one side edge portion of said slidable clamping member for meshing with the teeth on said soleplate.

13. A safety ski binding according to claim 11, further including a retaining spring mounted on said clamping screw for holding said slidable clamping member in a clamping position.

* * * * *